US007377799B2

(12) United States Patent
Kuo

(10) Patent No.: US 7,377,799 B2
(45) Date of Patent: May 27, 2008

(54) ELECTRICAL CONNECTOR HAVING IMPROVED FASTENING DEVICE

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/599,854

(22) Filed: Nov. 14, 2006

(65) Prior Publication Data

US 2007/0111584 A1 May 17, 2007

(30) Foreign Application Priority Data

Nov. 14, 2005 (CN) ..... 2005 2 0077823 U

(51) Int. Cl.
*H01R 13/627* (2006.01)

(52) U.S. Cl. ..... 439/362; 439/339; 439/731

(58) Field of Classification Search ..... 439/362, 439/361, 359, 310, 339, 731, 906
See application file for complete search history.

(56) References Cited

U.S. PATENT DOCUMENTS 5,342,216 A 8/1994 Davis et al.
5,383,795 A * 1/1995 Falossi et al. ..... 439/362
5,647,758 A 7/1997 Ichikawa et al.
6,059,599 A 5/2000 Huang
6,439,916 B1 * 8/2002 Kuo ..... 439/362
D495,660 S * 9/2004 Huang ..... D13/147
7,033,202 B2 4/2006 Wu
2003/0073337 A1 * 4/2003 Guo ..... 439/362

* cited by examiner

*Primary Examiner*—Tho D. Ta
*Assistant Examiner*—Travis Chambers
(74) *Attorney, Agent, or Firm*—Wei Te Chung

(57) ABSTRACT

An electrical connector includes an outer casing, an electrical connector module received and retained in the outer casing, at least one fastening device mounted in the outer casing, the fastening device comprising a manual handle, a rod partially received in the manual handle and defining a slot, and a C-ring surrounding and extending beyond the slot for forming a circumferential rib around the rod, and a retention board received in the outer casing, and spaced a predetermined distance from the C-ring originally. When the manual handle is turned by a user, the rod can be driven by the manual handle and move axially relative to the manual handle until the C-ring is barred by the retention board.

7 Claims, 10 Drawing Sheets

ELECTRICAL CONNECTOR HAVING IMPROVED FASTENING DEVICE

BACKGROUND OF THE INVENTION

1. Field of the Invention

The present invention generally relates to an electrical connector, and more particularly to an electrical connector having improved mechanism for attachment of the electrical connector to a mating electrical connector.

2. Description of Related Arts

It is well known that a cable end connector terminates to an electrical cable and electrically connects with a mating connector to transmit signals from the electrical cable to the complementary connector. The cable end connector and the mating connector are often equipped with interlocking mechanisms to secure two mated connectors together.

For example, U.S. Pat. No. 5,647,758, which published on Aug. 30, 1994 and assigned to Whitaker shows a conventional connector having a pair of jackscrews 16. Referring to FIGS. 1, 4 and 8, two cover parts 8 together define a locking finger 164 in each of the passages 9. Each jackscrew 16 has a collar 198 located at front of the locking finger 164, and an enlarged diameter portion 200 located behind of the locking finger 164. When the jackscrews 16 is pushed to engage with, or pulled to separate from a mating connector, the enlarged diameter portion 200, and the collar 198 is respectively hold by the locking finger 164, for controlling an operative distance of the jackscrew 16. However, to obtain the jackscrew 16 with the collar 198 and the enlarged diameter portion 200, the user needs an enlarged diameter pole originally and then lathes the pole to form the collar 198 and the enlarged diameter portion 200 in a lathe process. This process leads to a waste of the raw material and a high cost of manufacture.

For another example, U.S. Pat. No. 6,059,599, which published on May 9, 2000 and assigned to Hon Hai shows a connector using another bolt member type for achieving an interconnect function. The bolt member has first and second bolt parts assembled to each other. The first bolt part defines a radiant head, and the second bolt part defines a corresponding radiant slot for receiving the radiant head therein. When the connector is in a connection manner, the second bolt drives the first bolt to move forwardly relative to the second bolt. In addition, respectively disclosed in U.S. Pat. Nos. 5,647,758, 7,033,202, U.S. Pub. No. 20030073337A1, some similar jackscrews are provided. However, with respect to these cited reference, a problem that how to control the moving of the jackscrew conveniently is raised and expected to solve, and further, after a frequent plug/unplug, the helical spring may be distorted and thus unable to be prevented by the C-ring.

Hence, an electrical connector is desired to overcome the disadvantage of the related references.

SUMMARY OF THE INVENTION

Accordingly, the object of the present invention is to provide an electrical connector having an improved fastening device for attaching the electrical connector to a mating connector conveniently.

Accordingly, another object of the present invention is to provide an electrical connector having an improved fastening device for decreasing a cost of the manufacture.

Accordingly, another object of the present invention is to provide a fastening device, which can effectively and reliably operate.

To achieve the above object, an electrical connector in according with the present invention comprises an outer casing, an electrical connector module received and retained in the outer casing, at least one fastening device mounted in the outer casing, the fastening device comprising a manual handle, a rod partially received in the manual handle and defining a slot, and a C-ring surrounding and extending beyond the slot for forming a circumferential rib around the rod, and a retention board received in the outer casing, and spaced a predetermined distance from the C-ring originally. When the manual handle is turned by a user, the rod can be driven by the manual handle and move axially relative to the manual handle until the C-ring is barred by the retention board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
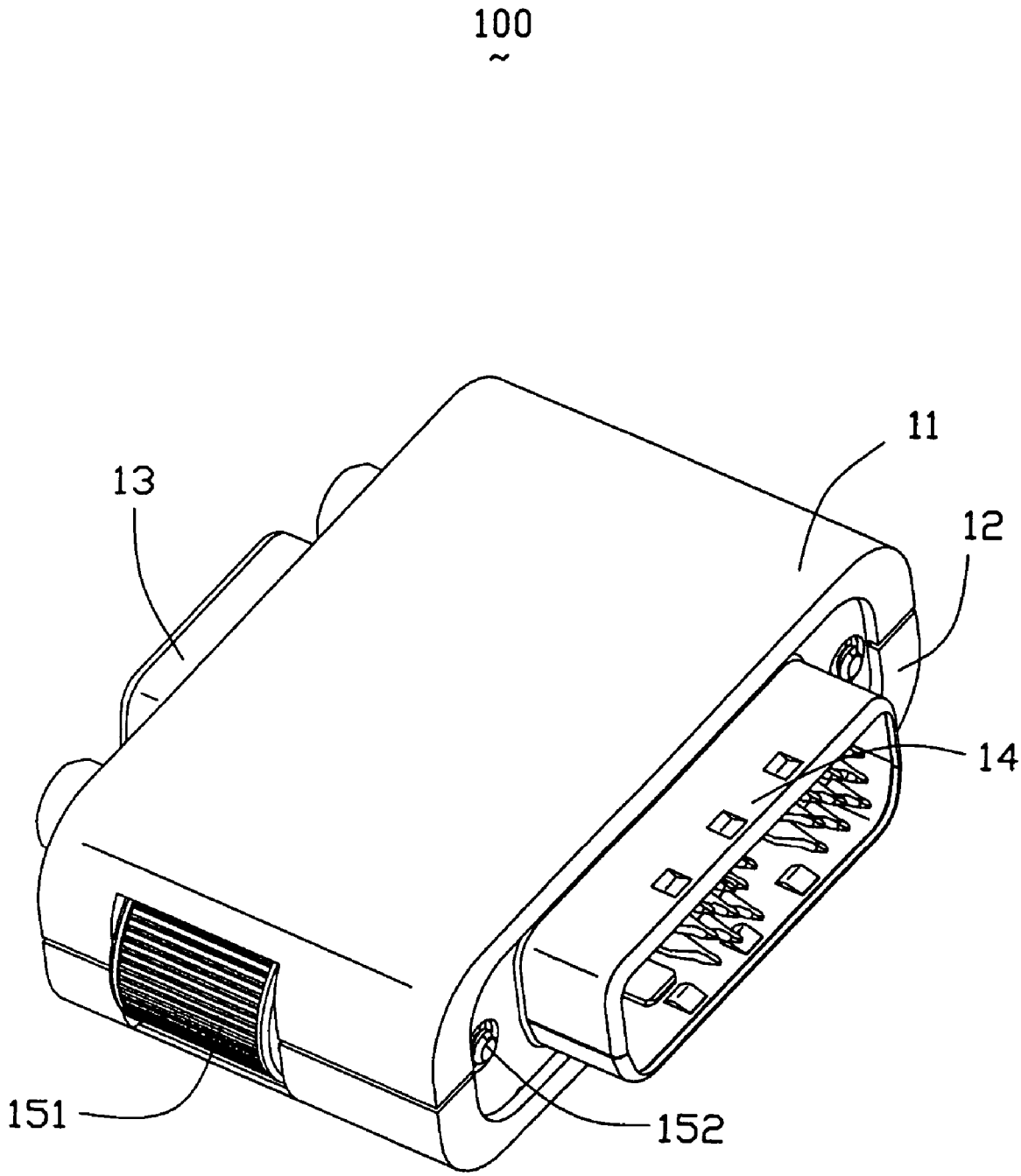
FIG. 1 is a perspective, assembled view of an electrical connector in accordance with the present invention.
Figure 2:
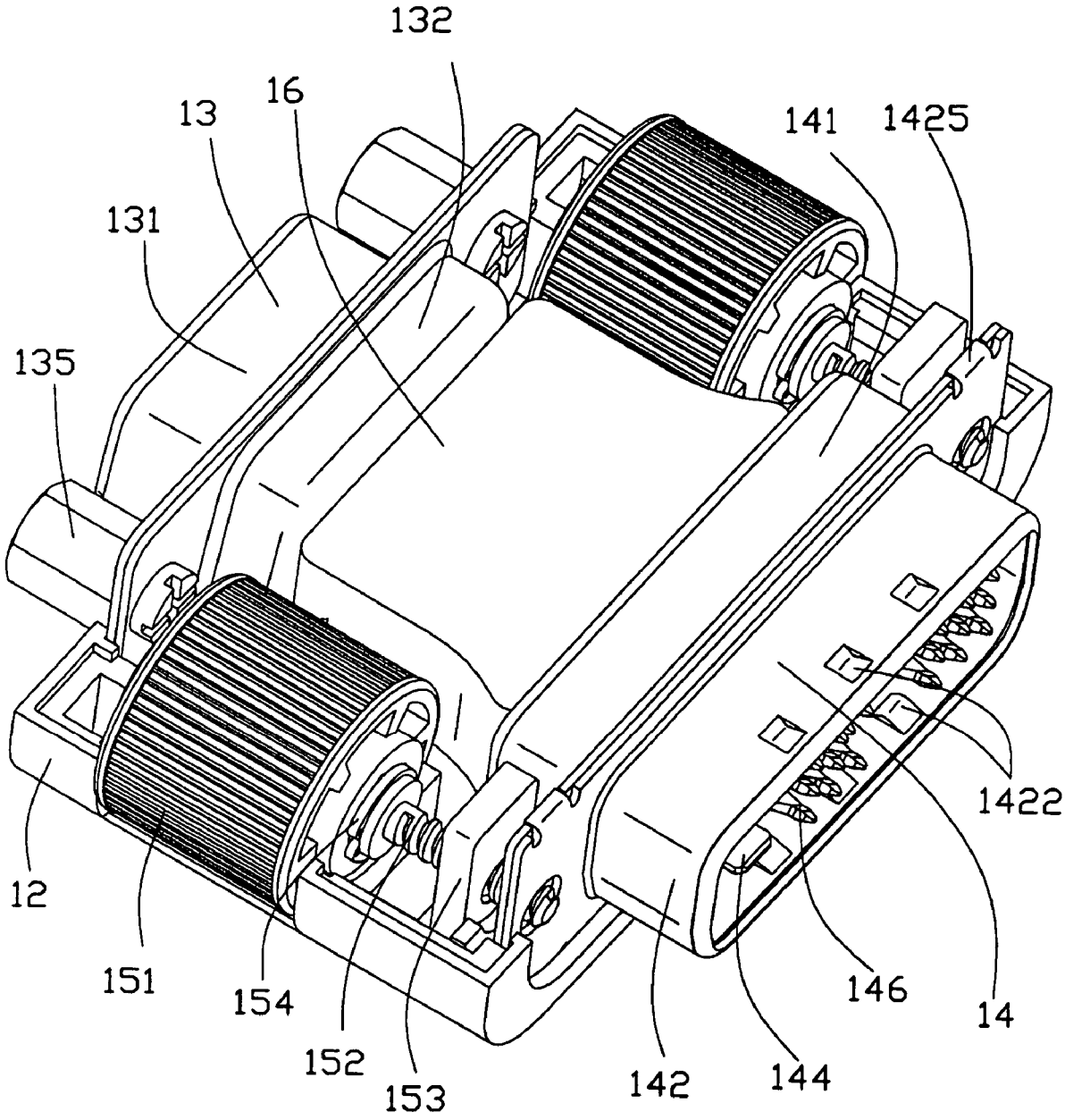
FIG. 2 is a perspective view of the inner structure of the electrical connector assembly of FIG. 1.

With reference to the drawings and in particular to FIGS. 1-2, an electrical connector 100 constructed in accordance with the present invention comprises an outer casing (not labeled) generally consisting of upper and lower halves 11, 12 mating each other and defining an interior space (not labeled) therebetween for receiving and retaining a first and a second connector module 13, 14, an intermediate module 16 and a pair of fastening devices 15. The intermediate module 16 is arranged between the first and second module 14 for achieving a signal transmitting function.

Figure 3:
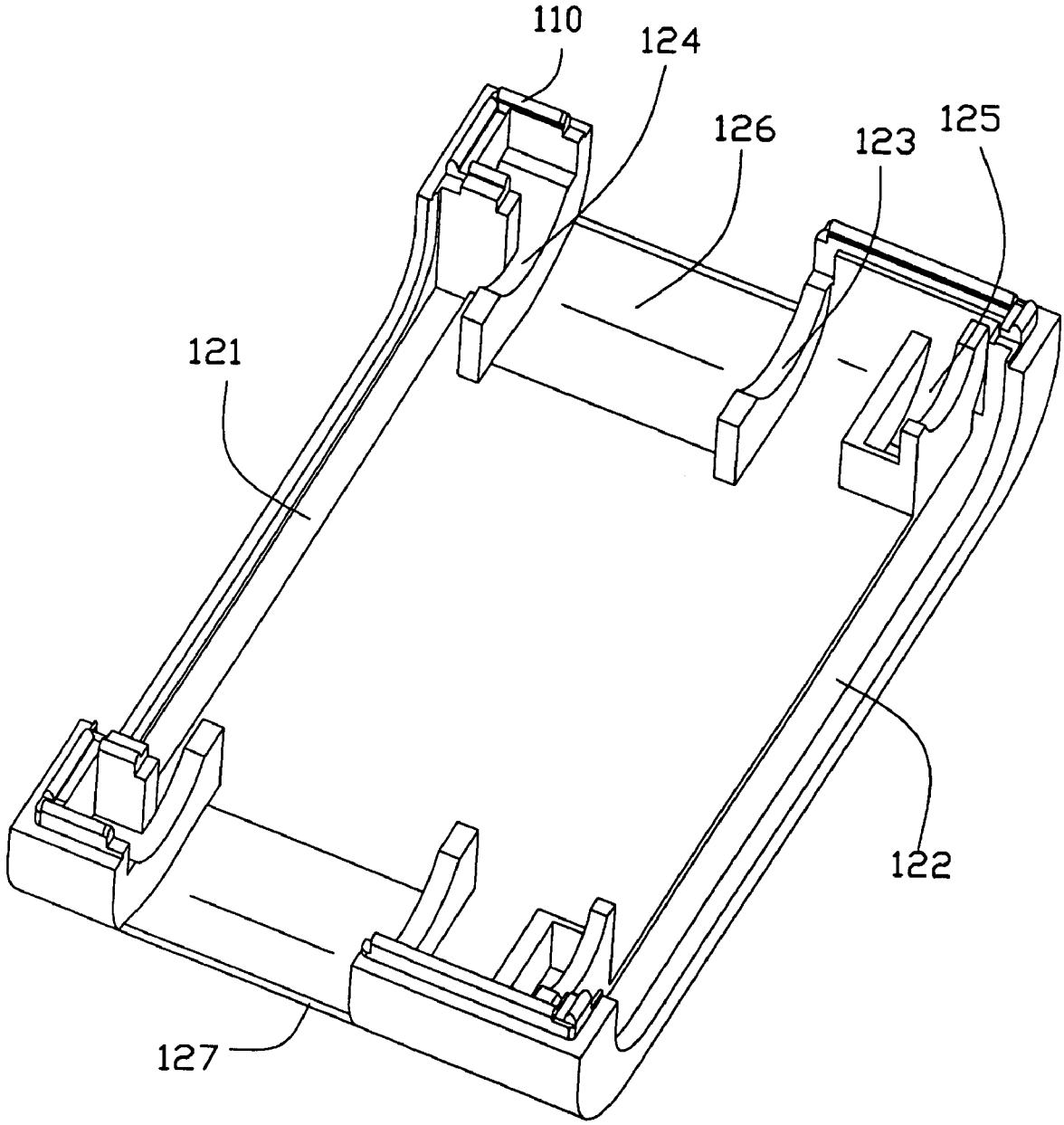
FIG. 3 is a perspective view of an upper halve of an outer casing of the electrical connector.
Figure 4:
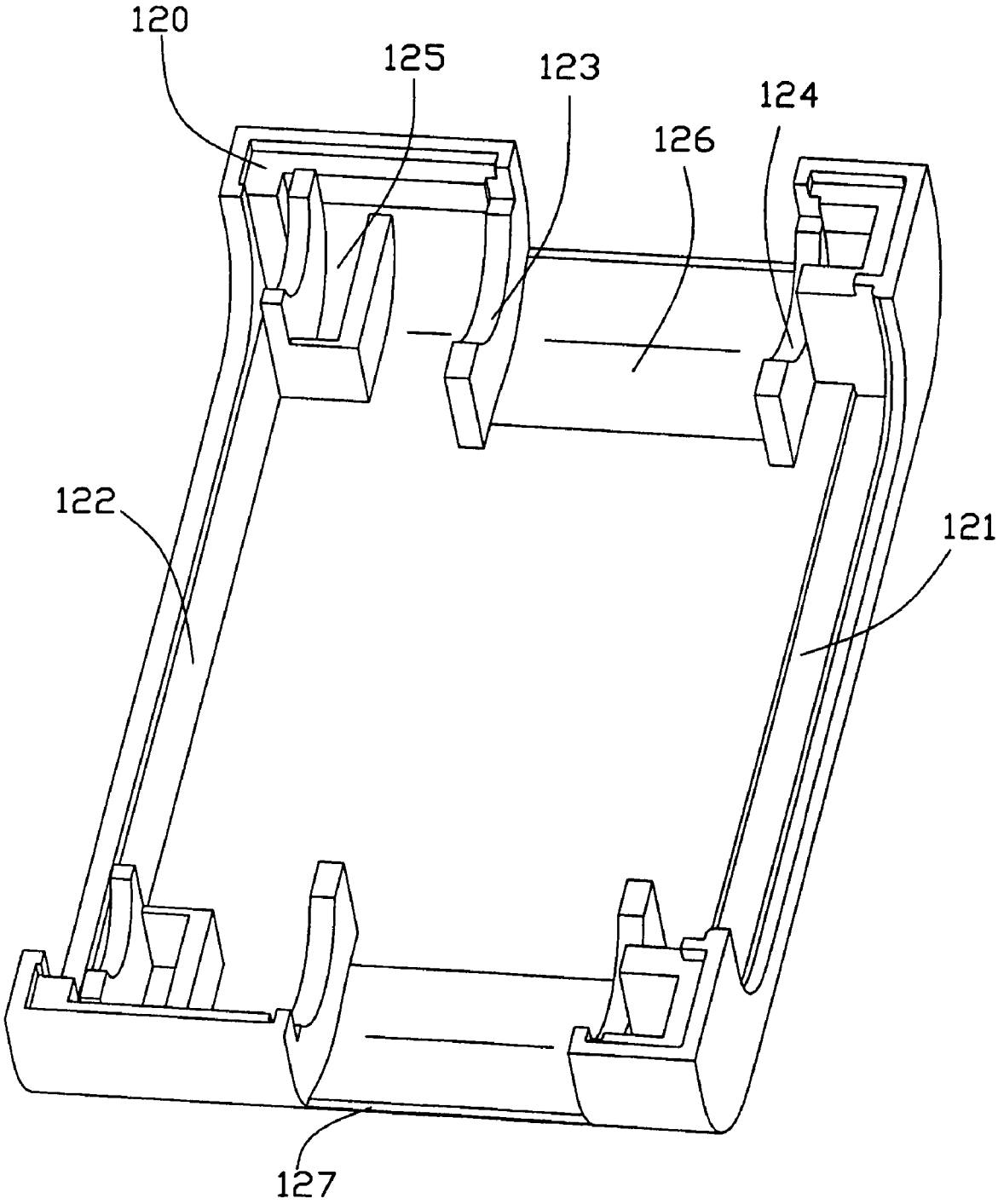
FIG. 4 is a perspective view of a lower halve of the casing of the electrical connector.

Referring to FIGS. 2 and 4, the upper halve 11 is similar to the lower halve 12 in structure, except that the upper halve 11 forms a plurality of retention ribs 110, and the lower halve 12 forms a plurality of receiving slots 120 for receiving corresponding retention rib 110 by an interference manner. Each halve of the outer casing defines a first receiving opening 121 and a second receiving opening 122 at two mating faces thereof for exposing the connector module 13, 14 to outside, and a pair of lateral portions (not labeled) at two sides thereof. Each lateral portion forms a front supporting piece 123 extending along a direction perpendicularly to a mating direction, a rear supporting piece 124 spaced with the front supporting piece 123 and forming a receiving space 126 therebetween together with the front supporting piece 123. A cambered gap (not labeled) is formed in the front and rear supporting piece 123, 124 for cooperating with and supporting a predetermined shape of the fastening device 15. Also referring to FIG. 3, a pair of openings 127 is defined in opposite lateral portion of outer casing and communicated with the receiving space 126 for partially exposing a manual handle 151 (illustrated as below) outside to allow a user to operate. A retention slot 125 is formed in front of and spaced a distance with the supporting piece 123. For illustrating the present invention conveniently, the distance is given a symbol "d".

Figure 5:
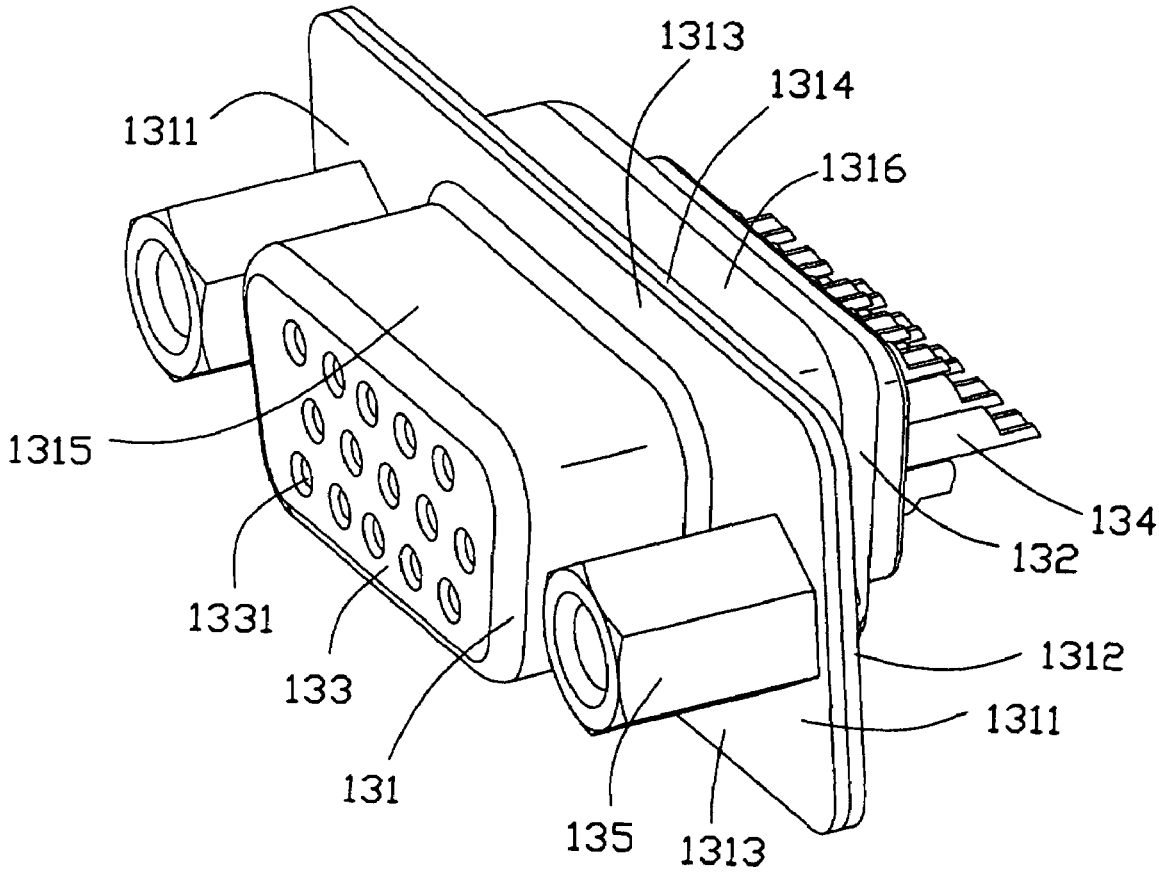
FIG. 5 is a perspective view of a first connector module of the electrical connector.
Figure 6:
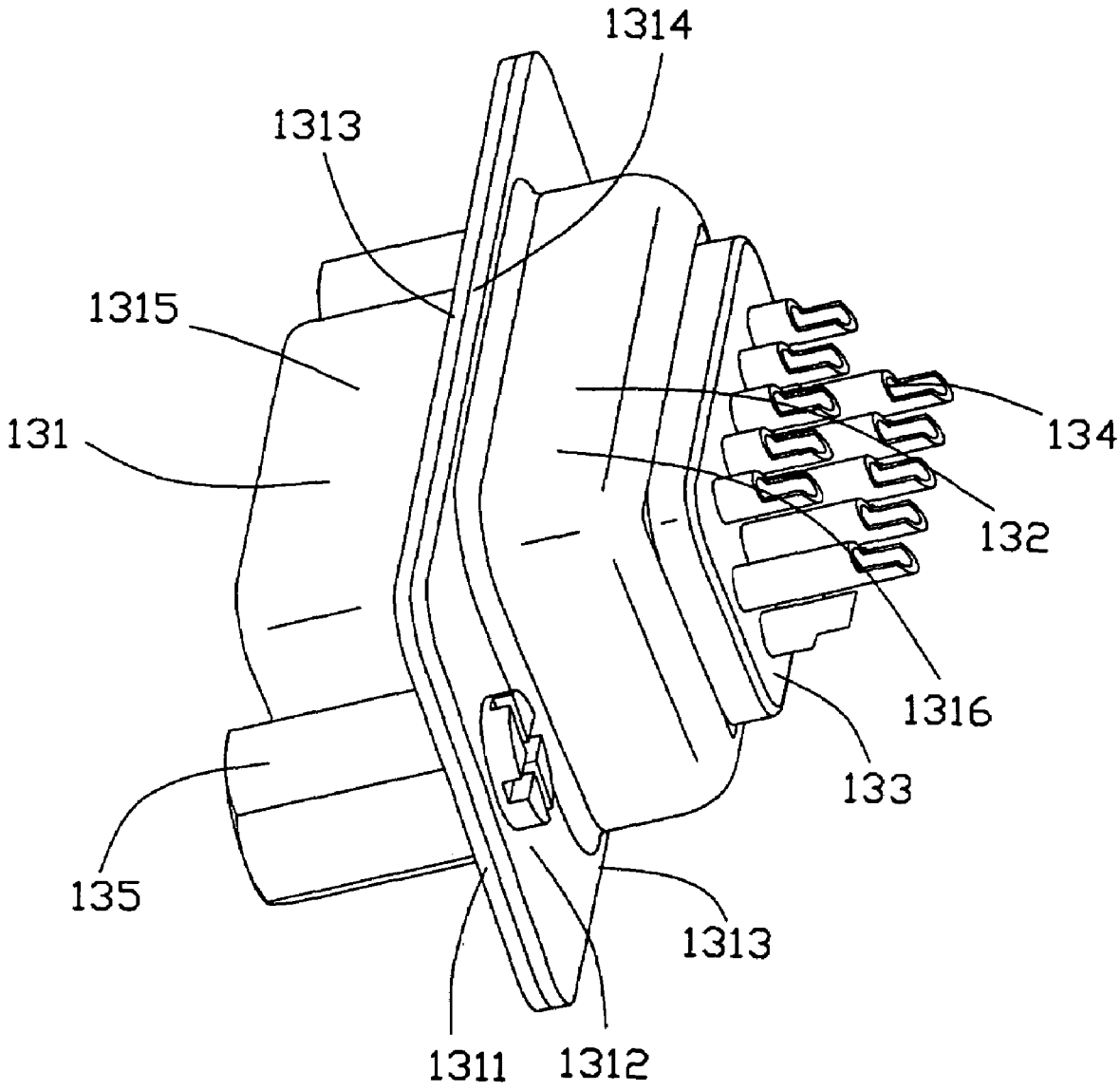
FIG. 6 is a perspective view of the first connector module of FIG. 5, but viewed from another direction.

Referring to FIGS. 5-6 and in conjunction with FIG. 2, the first connector module 13 with a female D-SUB interface, comprises a first shell 131, a second shell 132 engagable with the first shell 131. In another preferable embodiment, the second shell 132 can be shaped integrally with the first shell 131 for reducing assembly time. The first shell 131 comprises a frame-like first main portion 1315, and a board-like first mating face 1311, and the second shell 132 comprises a second main portion 1316, and a second mating face 1312 arranged side by side with the first mating face 1311. A first connector housing 133 is hold in a receiving space defined by the first and second shell 131, 132, and defines a plurality of contact receiving apertures 1331 for receiving corresponding tube-like contacts 134 therein. The first and second main portion 1315, 1316, and the first connector housing 133 are preferably shaped as a trapezium for preventing a misplug when the first connector module 13 is plugged into another mating connector. The first connector module 13 is received in the outer casing and hold in position by engagement between a first and second locking edges 1313, 1314 and the receiving opening 121. Also referring to FIG. 5, the first shell 13 further comprises a pair of poles 135 arranged on opposite sides of the first main portion 1315 and defining a screw hole by which an exterior screw can be rotate in.

Figure 7:
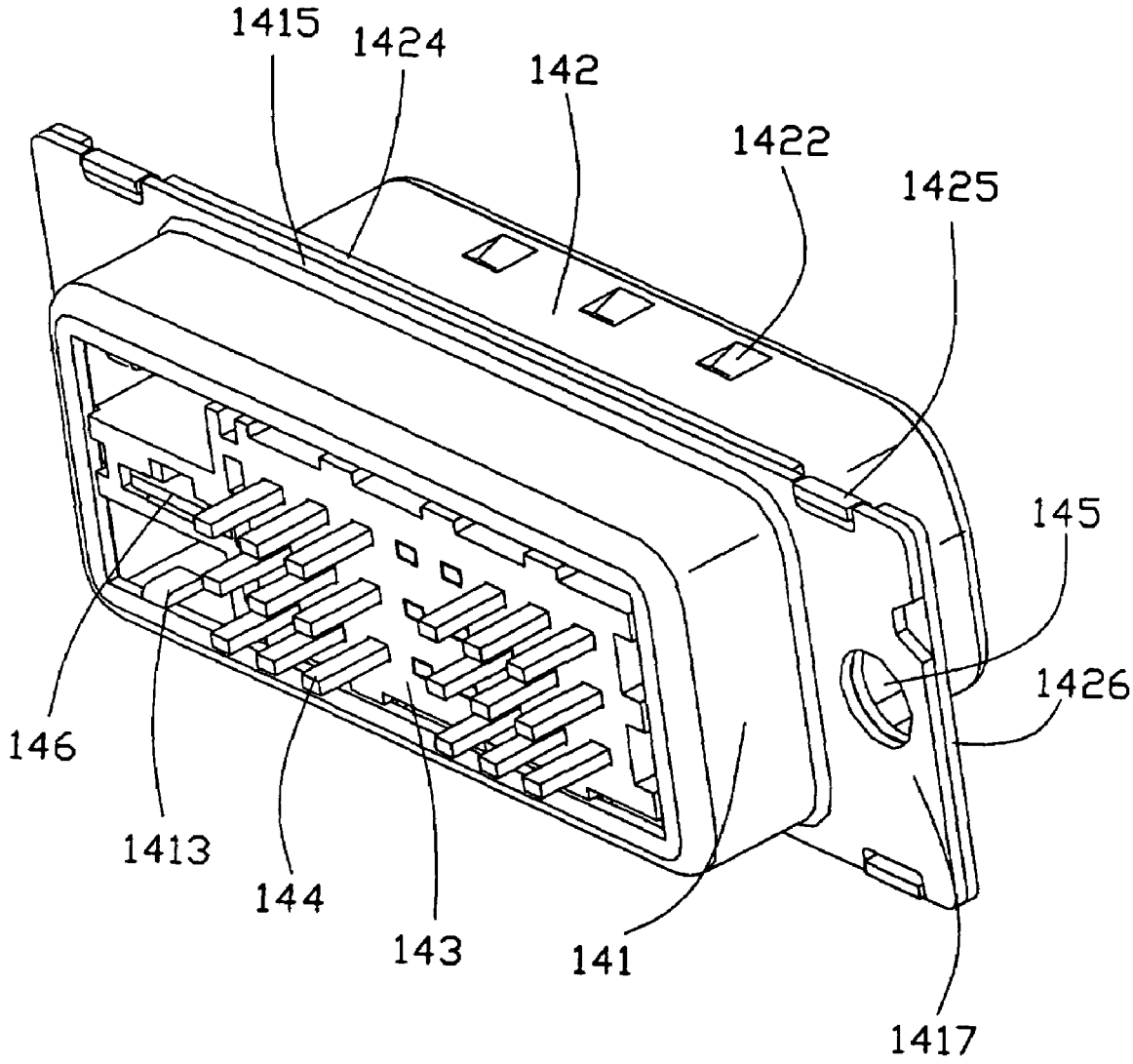
FIG. 7 is a perspective, assembled view of a second connector module of the electrical connector.
Figure 8:
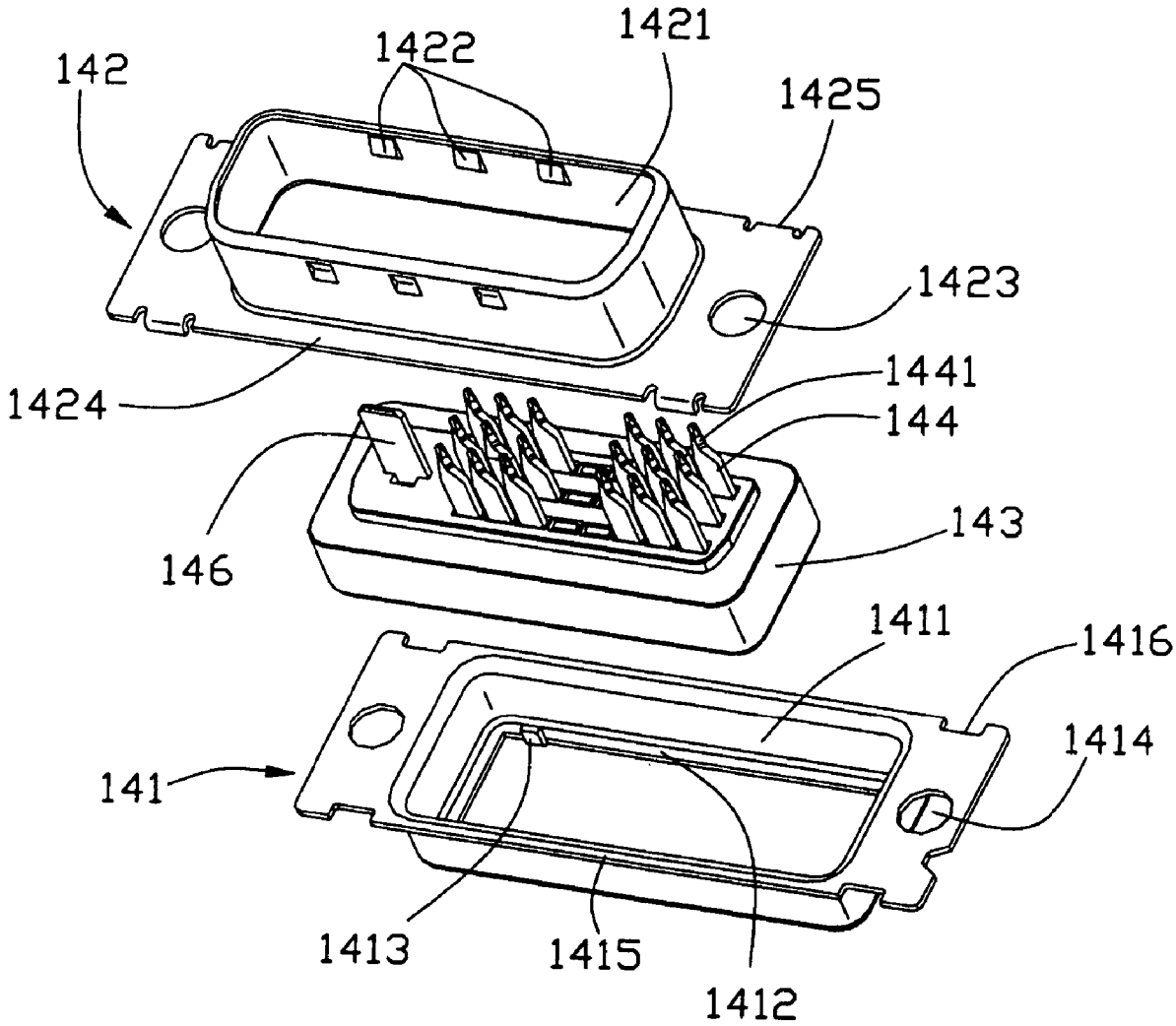
FIG. 8 is a perspective, exploded view of the second connector module of the electrical connector.

Also referring to FIGS. 7-8, the second connector module 14 with a male D-SUB interface, comprises a third shell 141, a fourth shell 142 engagable with the third shell 141 and defining a space together with the third shell 141, a second connector housing 143 received in said space, a plurality of second contacts 144, 146 retained in the connector housing 143. The shells 141, 142 is reliably connected to each other via the engagement between a plurality of locking slots 1416 defined on two sides of the third shell 141 and corresponding locking barbs 1425 defined on two sides of the fourth shell 142. Further, the shells 141, 142 all form a third main portion 1411, and a fourth main portion 1421 which are extending along a reversed direction and shaped as a frame, a third mating face 1417, and a fourth mating face 1426 arranged side by side with the third mating face 1417. The second connector module 14 is received in the outer casing and hold in position by engagement between a third and fourth locking edges 1415, 1424 and the receiving opening 122. Preferably, a protrusion 1413 is respectively formed on the shell 141 for holding the second connector housing 143 in position when the connector housing 143 is plugged into the shell 141. Similarly, a plurality of projecting 1422 is formed on the shell 142, whereby the second connector module 14 can mate with a mating connector in an interference manner and provide a grounding trace. At two lateral sides of the third and fourth mating faces 1417, 1426, a pair of through hole 1414, 1423 is provided and aligned along a mating direction through which a helical thread 152 (illustrated as below) of the jackscrew 15 extends.

Figure 9:
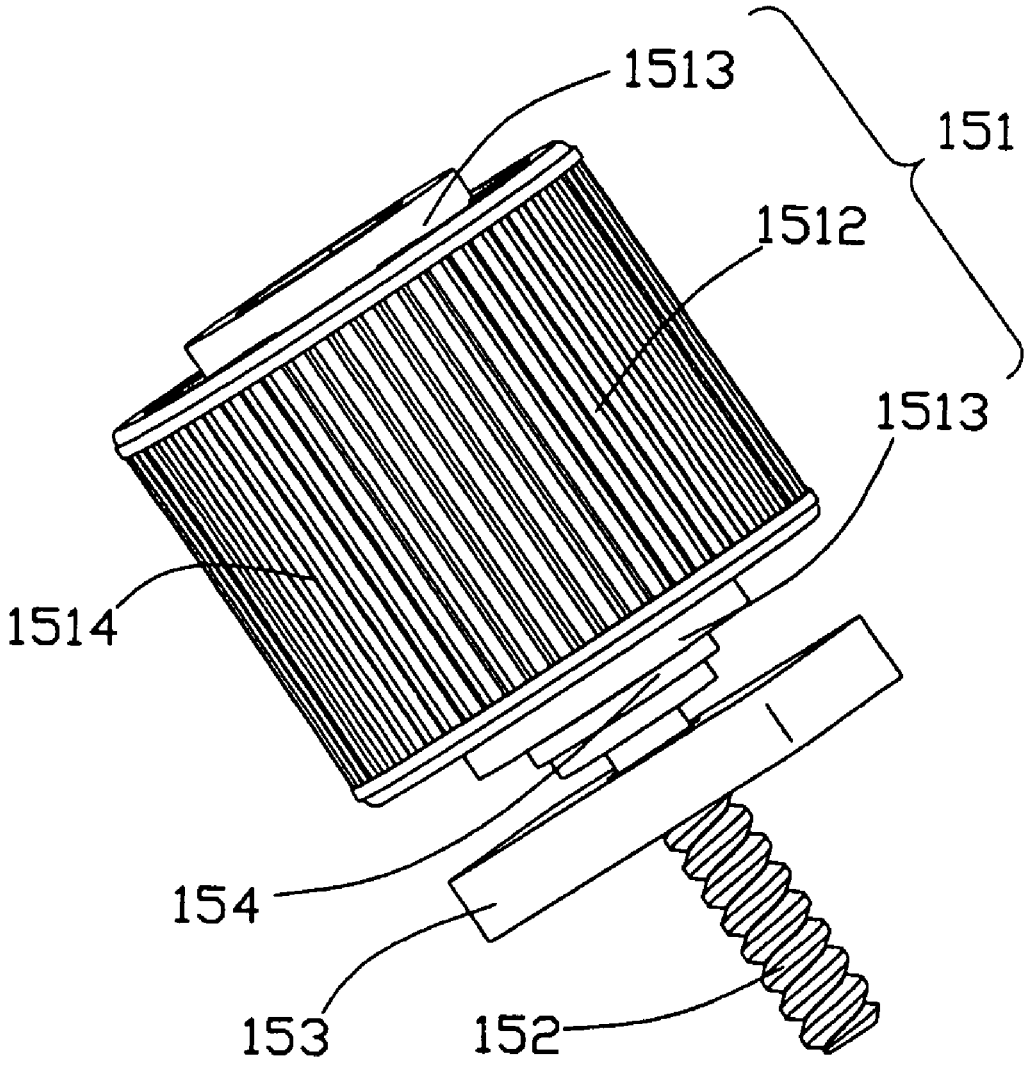
FIG. 9 is a perspective, assembled view of a fastening device of the electrical connector.
Figure 10:
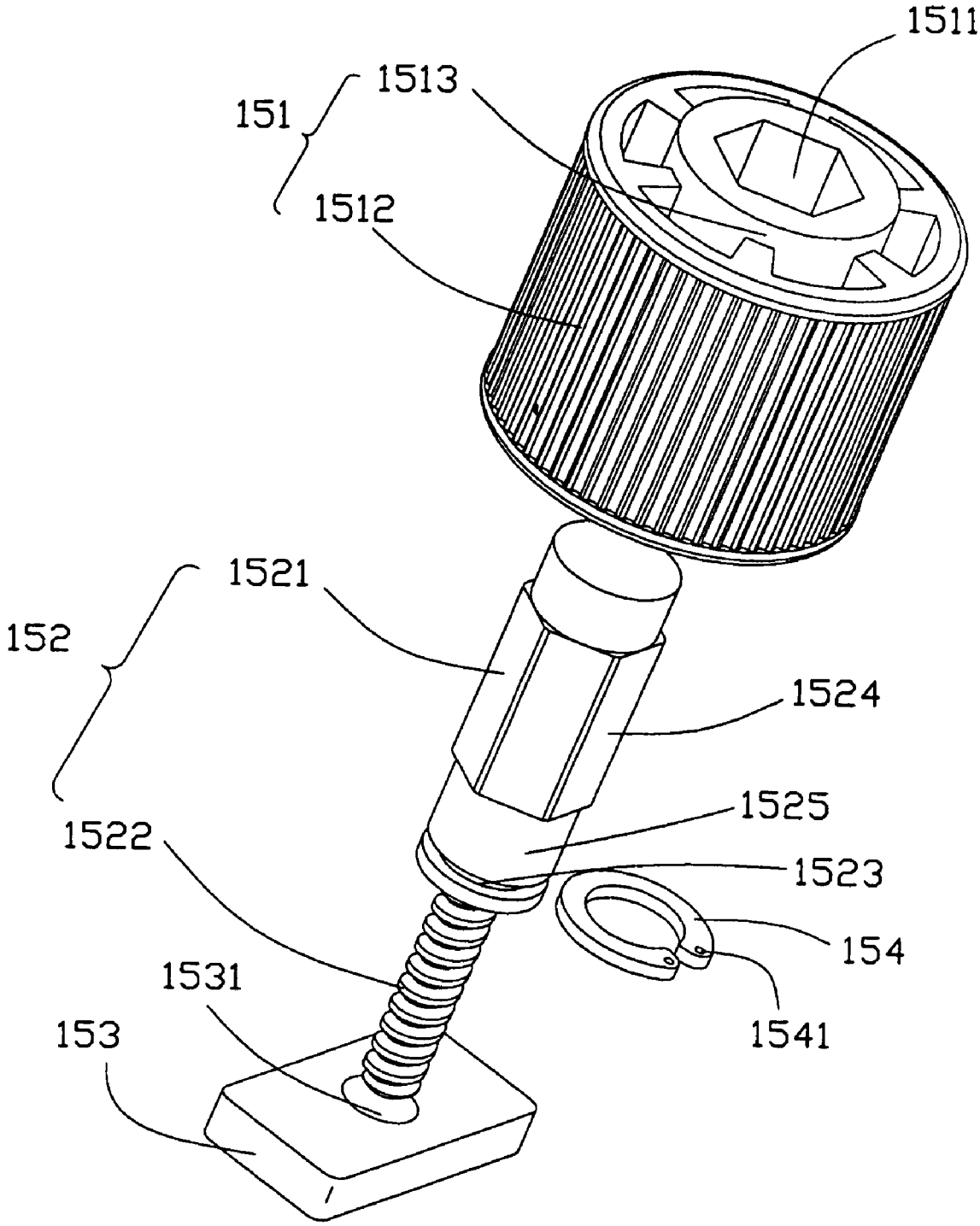
FIG. 10 is a perspective, exploded view of the fastening device of FIG. 8.

Referring to FIG. 9 and FIG. 10, the fastening device 15 comprises a manual handle 151, a rod 152 moving forwardly/rearwardly relative to the manual handle 151 when the electrical connector 100 is engaged with/unplugged from the mating connector, a retention board 153 defining a through hole 1531 extending therethrough, and a C-ring 1541 rotatablely retained on the rod 152. The manual handle 151 with a generally cylinder shape, comprises an exterior circle 1512, and an inner circle 1513 with a smaller diameter relative to the exterior circle 1512, extending along the mating direction and beyond the front and rear faces of the exterior circle 1512. For providing enough friction and making an operation conveniently, a plurality of slots 1512 is provided on the outer wall of the exterior circle 1512. Further, a hexagonal through hollow 1511 is defined in the inner circle 1513, through which the rod 152 extends.

Along the mating direction, the rod 152 comprises a helical thread 1522, a pole 1521 orderly. This pole 1521 comprises a hexagonal portion 1524, and a cylinder potion 1525 located between the helical thread 1522 and the hexagonal portion 1524. The cylinder portion 1523 defines an annular slot 1523 for allowing the C-ring 154 to rotatablely retain thereon. Preferably, a diameter of the helical thread 1522 is smaller than that of the cylinder portion 1523 and the hexagonal portion 1524, a diameter of the C-ring 154 is lager than that of the hexagonal portion 1524, the hexagonal through hollow 1511 and the through hole 1531, in such a way that the C-ring 154 surrounds the pole 1521 and extends beyond the annular slot 1523, forming a circumferential rib around the pole 1521, except a side opening 1541.

Referring to FIGS. 1-10, in assembly, the first connector module 13, the second connector module 14, and the intermediate module 16 are received in the outer casing and establish an electrical connection therebetween. Noticeably, the mating direction of the first connector module 13 is opposite to that of the second connector module 14, whereby two connector modules 13, 14 can mate with corresponding connector accordingly. However, in another embodiment, the mating direction of the first connector module 13 can be designed vertically relative to that of the second connector module 14 without departing from the essential conceive of present invention. Further, the retention board 153 is vertically received in the retention slot 125, with the through hole 1531 aligned with the through holes 1414, 1423. The rod 152 is assembled to the manual handle 151, with the pole 1521 being received in the hexagonal through hollow 1511 and being impossible to circumferentially rotate by means of the engagement between the hexagonal portion 1524 and the hexagonal through hollow 1511. The manual handle 151, together with the rod 152, are assembled to and restrictedly retained in the receiving space 126 of the outer casing, and supported and restrictedly retained by the front and rear supporting pieces 123, 124, with part of the manual handle 151 being accessible from the opening 127. After assembly, the helical thread 1522 extends through the aligned through holes 1531, 1414 and 1423.

Referring to FIGS. 2 and 9, originally, the C-ring 154 is abutting against the outside of the inner circle 1513 for preventing the pole 152 moving rearwardly. When the electrical connector is pushed to engage with the mating connector, a user turns the manual handles 151, with the helical threads 1522 being rotatablely engaged with helical holes of the mating connector. Noticeably, the whole poles 152 move continuously and axially and drive the C-rings 154 to move towards the retention boards 153. After a distance "d" defined above, the C-rings 154 is barred by the retention boards 153 for preventing excessive forwardly-moving. Simultaneously, the helical threads 1522 are reliably engaged with the mating connector. The unplug process from the mating connector is similar to above engagement process, except that the C-rings 154 are barred by the inner circles 1513. Apparently, the travel distance of the C-rings 154 is equal to that of the helical threads 1522. Further, in another preferable embodiment, the retention board 153, functioned as a bar, can be replaced by the shell of the connector module 13, 14. In other words, the C-ring 154 is barred by the shell 14, for the reason of that the diameter of C-ring is larger than that of the through hole 145.

Compared with the prior arts in which the fastening is lathed the raw materials between the enlarged diameter portion 200 and the collar 198 to form the collar 198, the original diameter of the pole 1521 of the present invention is smaller, and the manufacturer only need lathe the annular slot 1523 for C-ring 154. In this way, manufacturers can save raw materials, and reduce the cost. Further, because the C-ring 154 surrounds the annular slot 1523, and can circumferentially rotate during a mating process, the C-ring 154 can not be abraded excessively when abutting against either the retention board 153 or the inner circle 1513. Thirdly, setting the C-ring 154 between the retention board 153 and the inner circle 1513 and defining a predetermined travel distance, can make a user control the plug/unplug conveniently.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An electrical connector comprising:

an outer casing;

first and second electrical connector modules received and retained in the outer casing with mating directions thereof opposite to each other;

an intermediate module located between the first and second electrical connectors to electrically connect the first and second electrical connector modules and enclosed by the outer casing;

at least one fastening device mounted in the outer casing, the fastening device comprising a manual handle only partially exposed outside of said outer casing for manual operation, a rod partially received in the manual handle with threads on a front portion and movable axially relative to the manual handle, and a C-ring surrounding and extending beyond the rod for forming a circumferential rib around the rod; and wherein when the manual handle is turned by a user, the rod with the C-ring moves axially grid forwardly relative to the manual handle until the C-ring moves a predetermined distance and is barred; wherein the rod comprises a helical thread, and a hexagonal portion received in a hexagonal through hollow defined by the manual handle and defining an annular slot for allowing C-ring to surround; wherein the electrical connector module comprises a shell defining a through hole with a diameter being smaller than that of the C-ring, through which the helical thread extends and the C-ring is barred.

2. An electrical connector comprising:

an outer casing:

first and second electrical connector modules received and retained in the outer casing with mating directions thereof opposite to each other;

an intermediate module located between the first and second electrical connectors to electrically connect the first and second electrical connector modules and enclosed by the outer casing;

at least one fastening device mounted in the outer casing, the fastening device comprising a manual handle only partially exposed outside of said outer casing for manual operation, a rod partially received in the manual handle with threads on a front portion and movable axially relative to the manual handle, and a C-ring surrounding and extending beyond the rod for forming a circumferential rib round the rod; and wherein when the manual handle is turned by a user, the rod with the C-ring moves axially and forwardly relative to the manual handle until the C-ring moves a predetermined distance and is barred; wherein the rod comprises a helical thread, and a hexagonal portion received in a hexagonal through hollow defined by the manual handle and defining an annular slot for allowing the C-ring to surround; wherein the electrical connector comprises a retention board received in the outer casing and defining a through hole, wherein the helical thread extends through the through hole and the C-ring is barred by the retention board.

3. An electrical connector comprising:

an outer casing;

an electrical connector module received and retained in the outer casing;

at least one fastening device mounted in the outer casing, the fastening device comprising a manual handle which is only partially radially exposed outside of said outer casing for manual operation, a rod partially received in the manual handle with threads on a front portion and movable axially relative to the manual handle; and a stopper having a larger diameter than the rod and fastened to the rod in an immovable manner; wherein the stopper is stopped before the treads arc completely coupled to counterpart threads.

4. An electrical adaptor comprising:

an outer casing defining thereof a longitudinal direction and a transverse direction perpendicular to each other;

opposite first and second ends formed on the housing along the longitudinal direction;

a first connector unit located at the first end;

a second connector unit located at the second end:

a pair of rods extending along the longitudinal direction and located at two lateral sides of the housing in the transverse direction, each of said rods defining a thread portion at a front end and an engaging portion behind said thread portion; and a manual handle at least partially exposed to an exterior, and the engaging portion assembled to the manual handle while being slidable relative thereto along the longitudinal direction so that when the thread portion of the rod is coupled to a counterpart thread portion of a complementary connector, by rotation of the manual handle the rod is commonly rotated therewith while sliding relative thereto along said longitudinal direction.

5. The adaptor as claimed in claim 4, wherein said manual handle is rotatable about an axis along said longitudinal direction but immoveable along said longitudinal direction.

6. The adaptor as claimed in claim 4, wherein the manual handle is exposed to the exterior alone said transverse direction for easy operation.

7. The adaptor as claimed in claim 4, wherein the manual handle is located between the first and the second connector units along said longitudinal direction.

* * * * *